United States Patent [19]

Orthmann

[11] 4,033,688

[45] July 5, 1977

[54] COLOR COPYING APPARATUS

[75] Inventor: Jürgen Orthmann, Munich, Germany

[73] Assignee: AGFA-Gevaert, Aktiengesellschaft, Leverkusen, Germany

[22] Filed: Feb. 10, 1976

[21] Appl. No.: 656,949

[30] Foreign Application Priority Data

Feb. 14, 1975 Germany ..... 2506366

[52] U.S. Cl. ..... 355/4; 355/8

[51] Int. Cl.[2] ..... G03G 15/01

[58] Field of Search ..... 355/4, 8, 11

[56] References Cited

UNITED STATES PATENTS 3,661,455 5/1972 Namiki et al. ..... 355/8 X 3,879,122 4/1975 Wick et al. ..... 355/4

*Primary Examiner*—R. L. Moses

*Attorney, Agent, or Firm*—Michael J. Striker

[57] ABSTRACT

A carriage carrying a plurality of scanners passes on a housing underneath an image-bearing master so as to produce three color-component beams that are each reflected through a set of mirrors onto a respective location on an image-receiving electrostatic drum. Each set of mirrors has at least one mirror that is displaceable so that the overall path length from the master to the drum remains the same and the image is picked off the master at an angle which is equal to the angle with which it is cast onto the image drum. Furthermore, the distance between the locations on the master from which the images are picked up is equal to the rectified arc length between the locations on the drum where the image is cast.

9 Claims, 2 Drawing Figures

COLOR COPYING APPARATUS

BACKGROUND OF THE INVENTION

The present invention relates to a color copying system. More particularly, this invention concerns an electrostatic color-copying apparatus.

An electrostatic color copier normally breaks down the image to be copied into several color-component beams, usually each corresponding roughly to one of the primary colors. To this end the image must be scanned several times, usually with the beam being passed through a filter and being produced by illumination of the surface being scanned with light of colors that suppress all but the desired color. The beams are then reflected onto a large image surface and an image former or toner of the requisite color is applied thereto for each beam. The separate images must register perfectly. The different toners can then be jointly transferred to a copy sheet and fixed so that the combined toners produce a copy image corresponding closely to the original on the master.

it is absolutely essential in such systems that the images formed for each color component register perfectly. For this reason recourse has usually been had to a planar image-receiving surface.

In order to increase the precision of registration it has been suggested to scan for all of the color components simulataneously through slit shutters spaced apart in the direction of scanning so that the variously colored image formers are laid on the image surface one behind the other and the chance of misregistration is greatly reduced.

Almost invariably such systems have complicated lens and reflecting arrangements that greatly increase the cost of the machine and the cost of the copies made thereby. Furthermore, these systems can only be employed with a planar image-receiving surface whose use greatly increases the size of the machines and the difficulty of transferring the image to a copy sheet without blurring.

SUMMARY OF THE INVENTION

It is therefore an object of the present invention to provide an improved color-copying system.

Another object is the provision of such a system which is relatively simple and which insures exact registration of the various color components.

A further object is to provide a system of this kind which can be effectively used not only with planar image-receiving surfaces, but also with non-planar image-receiving surfaces.

These objects are attained according to the present invention in a copying apparatus comprising a housing that fixedly supports an image-bearing master. A carriage in the housing is displaceable at a scanning speed past the master and carries a plurality of relatively fixed and parallel shutters or viewing slots spaced apart in the direction of displacement of the carriage. Scanning means is provided on the carriage at each of the shutters for directing therethrough a respective beam of a respective color component of the image of the master. A rotatable image drum in the housing has a cylindrical outer image-receiving surface of electrostatically chargeable photosensitive material. This drum is rotated at a peripheral velocity substantially equal to the scanning speed. A set of mirrors is aligned with each of the shutters and reflects the respective beam along a respective path originating at the master and terminating at a respective location on the drum. Each mirror set has an even number of mirrors, including a first mirror located closest along the path to the master position and serving to pick up the respective beam at a predetermined angle and a last mirror located closest along the path to the drum and serving to direct the respective beam at substantially the same predetermined angle against the respective location on the drum. The rectified length of the arc on the drum between adjacent locations is equal to the spacing on the master between the corresponding path origins. Means is provided for displacing one of the mirrors of each of the sets synchronously with the carriage so that the paths maintain constant length between their origins on the master and their termini on the drum during displacement of the carriage. At least a one lens is provided in the paths equidistant between their origins and termini. Means is provided for charging the drum immediately upstream — in the rotational sense of the drum — of each of the locations and for applying an image former thereto immediately downstream of the respective location. Further means applies a copy sheet to the drum downstream of the location so as to transfer the image defined on the drum by the image former to the sheet.

With such a system the image is exactly reproduced on the surface of the image drum backward from the original. Exact registration is assured by the synchronous displacement of the carriage, mirrors, and image drum so that relatively high scanning speed can be employed.

In accordance with further features of this invention the first mirror of each set is secured rigidly on the carriage and forms with the master an angle equal to $45° + \alpha/2$, wherein $\alpha$ is an angle between 0°and 90°. The mirror of each set that receives the beam from the first mirror lies at an angle of 90° to the master. The second mirror, that mirror receiving the image from the first mirror, is displaced in the housing at an acute angle to the displacement direction of the carriage at a rate $v$ equal to $v/(2 \cos \alpha)$, so as to move ortogonally away from the carriage at a rate equal to $(v \tan \alpha)/2$. Such an arrangement minimizes light loss by using the smallest possible number of reflecting surfaces.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
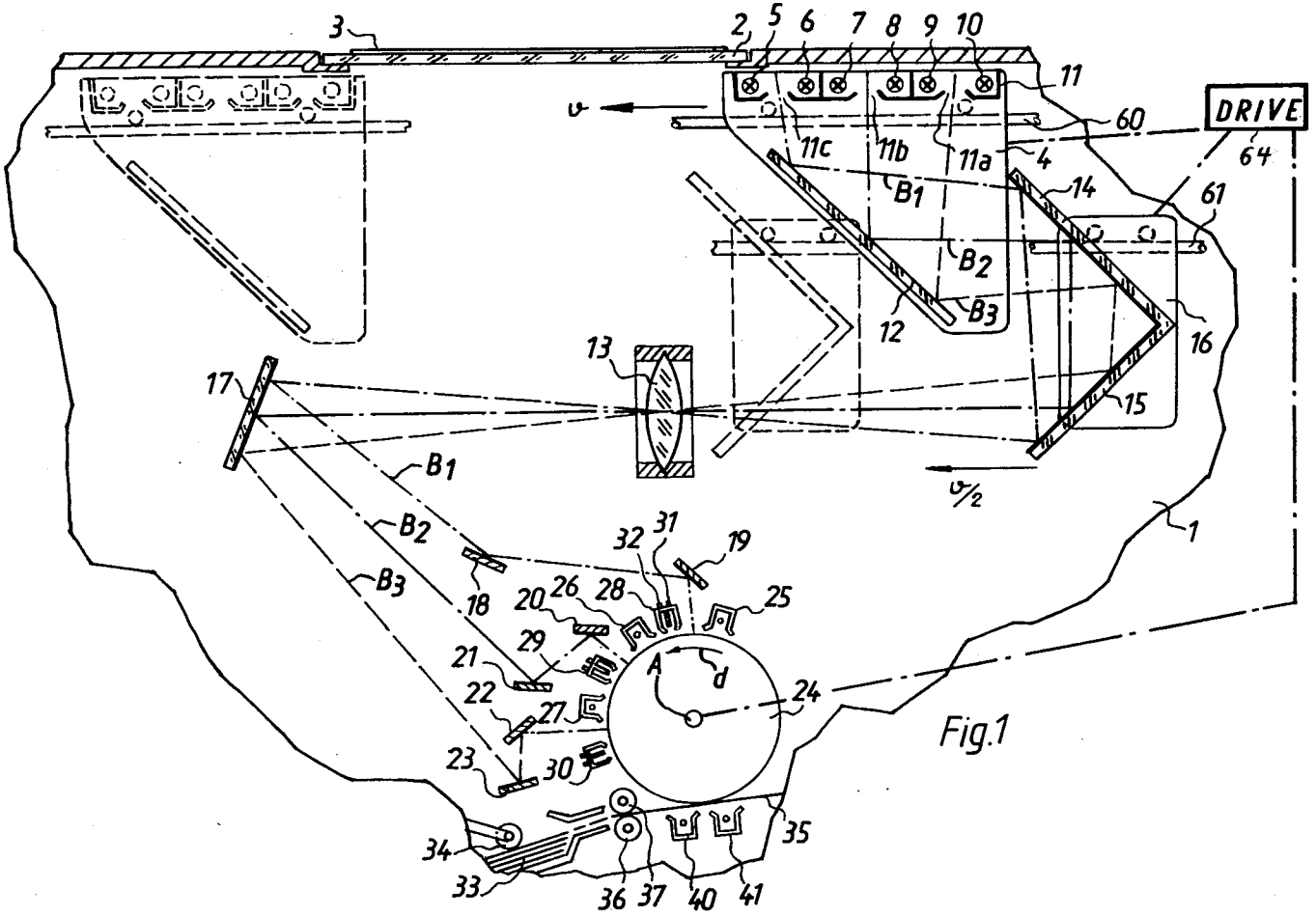
FIG. 1 is a sectional view partly in schematic form, illustrating a first copying system in accordance with this invention.

The apparatus shown in FIG. 1 has a housing 1 provided on its upper wall with a planar transparent window 2 of glass or another material, on which is laid an image-bearing master 3. A carriage 4 is displaceable underneath this window 2 in a horizontal direction on a horizontal rail 60 at a scanning speed $v$. Fluorescent lamps 5 – 10 are carried on the carriage 4 adjacent shields 11 defining parallel and spaced-apart shutter-slots 11*a*, 11*b*, and 11*c*. These lamps 5 – 10 illuminate the master 3 as the carriage passes under it so that beams as indicated in dot-dash lines $B_{1-3}$ in FIG. 1 issue from the shutter slots, the lamps 5 – 10 radiate respective color components corresponding to the desired components to be drawn off by each such scanner so as to suppress unwanted colons.

A planar mirror 12 arranged at an angle of approximately 45° to the window 2 is carried on the carriage 4 and directs the beams $B_{1-3}$ against a pair of deflecting mirrors 14 and 15 supported on another carriage 16 and arranged at right angles to each other with the mirror 14 parallel to the mirrors 12. The carriage 16 is displaced by a drive 64 synchronously with the carriage 4 and parallel thereto at a velocity equal to $v/2$.

The beams of light $B_{1-3}$ indicated in dot-dash lines are reflected from the mirror 15 through a focusing lens 13 fixed in the housing 1. These beams are then reflected off another single planar mirror 17 onto mirrors 18, 21 and 23 and thence onto mirrors 19, 20, and 22 which reflect these beams onto angularly spaced-apart locations on a cylindrical image drum 24. The drive 64 rotates this image drum 24 about its axis A in a direction $d$ at a peripheral speed equal to $v$.

The various beams $B_{1-3}$ are reflected along a path having an overall length that is exactly bisected by the lens 13. Furthermore, the distances between the origins of the various beams on the master 3 are exactly equal to the rectified arc length between the locations reflected onto the drum 24. The angle with which each of the beams is picked off the master 3 through the respective slots 11*a – c* is equal to the angle at which they are reflected onto the drum 24 by the mirrors 19, 20, and 22. Should it be desired to use the arrangement for enlarging or reducing the size of the image, the lens 13 is displaced in the appropriate direction whereby the locations on the drum are similarly positioned closer to one another or further apart, as a lens of different front and back focal lengths is employed.

Immediately upstream of each location on the drum 24 there is provided an electrostatic corona charging devie 25, 26, and 27 and immediately downstream of each such location are respective toner appliers 28, 29, and 30. Each such strip-like toner applier 28, 29, and 30 has an inlet 31 for blowing toner down against the surface of the drum 24 and an outlet 32 for aspirating from the selenium surface of the drum any toner that has not electrostatically adhered thereto.

Copy sheets 35 from a pile 33 are advanced underneath the drum by a feed device 34 and a pair of feed rollers 36 and 37. Conventional corona charging devices 40 and 41 for pulling the toner off the drum 24 and adhering and fixing it to the surface of the copy sheets 35 are provided underneath the drum 24.

Figure 2:
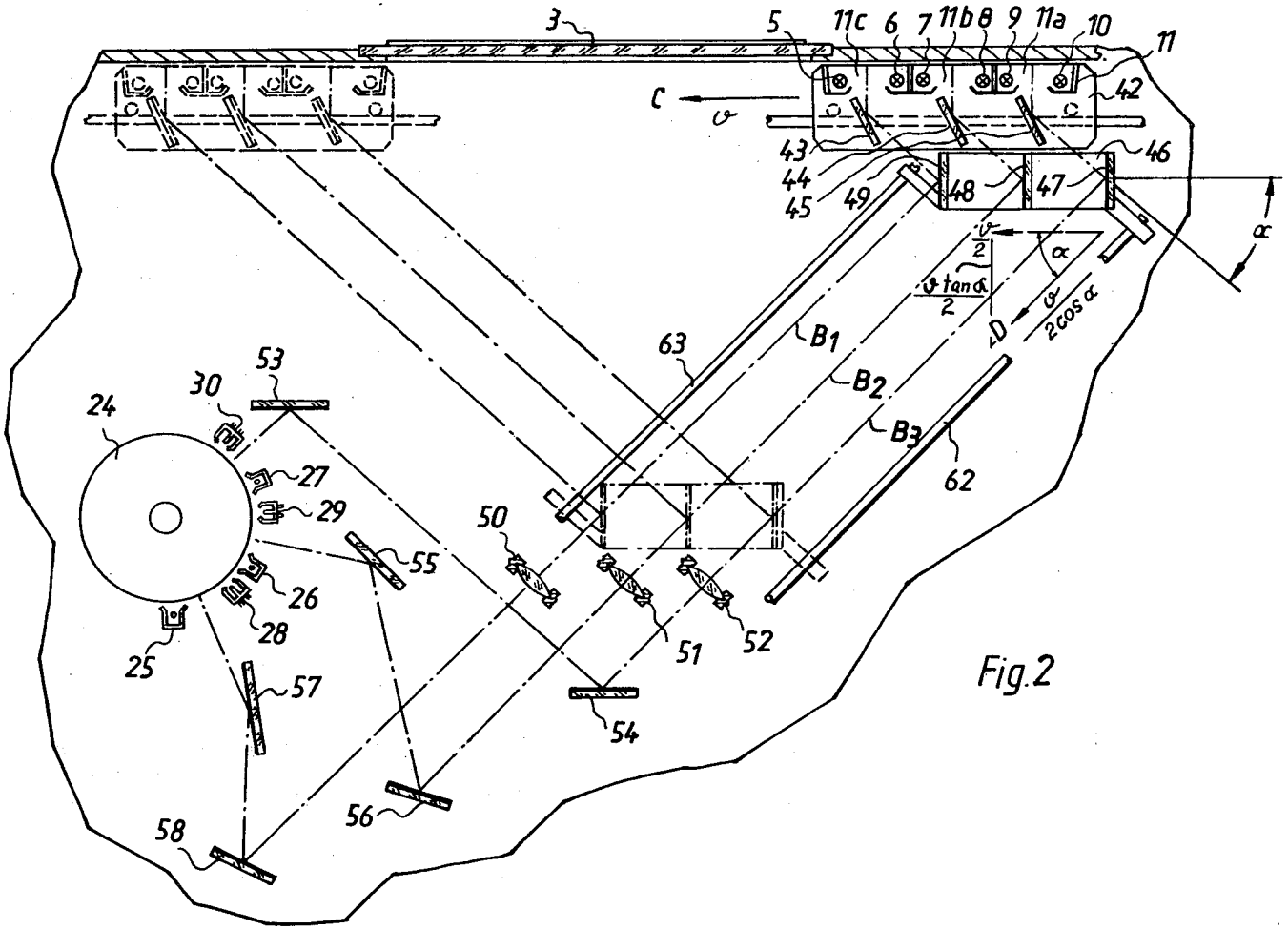
FIG. 2 is a view similar to FIG. 1 but illustrating a further system according to the invention.

Coming to FIG. 2 it is pointed out that structure in FIG. 2 that is functionally indentical to structure in FIG. 1 bears the same reference numerals. In the arrangement of FIG. 2 a carriage 42 similar to the carriage 4 carries three separate reflecting mirrors 43, 44, and 45, each aligned with a respective shutter slot 11*c*, 11*b*, and 11*a*. Beams $B_{1-3}$ are then reflected off three mirrors, 48, 49 and 47, carried on a carriage 46 and perpendicular to the master 3. This carriage 46 is displaceable on tracks 62 and 63 extending at an angle $\alpha$ to the master 3. The drive is effective to move the carriage 46 along these rails at an effective downward speed D equal to $v/(2 \cos \alpha)$. Thus the carriage moves parallel to the master 3 at a speed equal to $v/2$ and perpendicular to the master 3 at a speed equal to $(v \tan \alpha)/2$. The beams then traverse respective lenses 50, 51, and 52 and are reflected from respective mirrors 58, 56, and 54 via further respective mirrors 57, 55, and 53 to the surface of a drum 24 identical to that in FIG. 1.

The arrangement of FIG. 2 has the advantage that only four reflective surfaces are provided in the path of each beam. Thus, light loss is reduced to a minimum so that an extremely sharp image may be produced.

In this system, as in the system of FIG. 1, the focal lengths of the lenses 50 – 52 are alike in both directions, and the lenses are placed in the middle of the beam path. For reduction or enlargement of the image size, however, other lenses can be employed, with a different distance therefore between the lenses to one side and to the other, and appropriate changing in the spacing of the focusing locations on the drum surface.

It will be understood that each of the elements described above, or two or more together, may also find a useful application in other types of applications differing from the types described above.

While the invention has been illustrated and described as embodied in a xerographic color copier, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art fairly constitute essential characteristics of the generic or specific aspects of this invention.

What is claimed as new and desired to be protected by Letters Patent is set forth in the appended claims:

1. A copying apparatus comprising: a housing fixedly supporting an image bearing master; a carriage on said housing displaceable at a scanning speed past said master and carrying a plurality of relatively fixed slot shutters spaced apart in the direction of displacement of said carriage; scanning means on said carriage at each of said shutters for directing therethrough a respective beam of a respective color component of the image on said master; a rotatable image drum on said housing; means for rotating said drum in a predetermined rotational sense at a peripheral velocity substantially equal to said scanning speed; a set of mirrors having an even number of mirrors aligned with each of said shutters for reflecting the respective beam along a respective path originating at said master and terminating at a respective location on said drum, the distance on said drum between said locations being equal to the distance on said master between the corresponding path origins, each path defining at its origin with the master an angle that is substantially equal to the angle it defines at its terminus with the respective location on said drum; means for displacing one of said mirrors of each of said sets synchronously with said carriage so that said paths maintain constant length between their origins on said master and their termini on said drum during displacement of said carriage; at least one lens in said paths equidistant between the origins and termini thereof; means for charging said drum immediately upstream of each of said locations and for applying an image former thereto immediately downstream of the respective location; and means for applying a copy sheet to said drum downstream of the respective location and for transferring the image defined on said drum by said formers to said sheet.

2. The apparatus defined in claim 1 wherein each scanning means includes means for illuminating said master and for suppressing unwanted colors.

3. The apparatus defined in claim 1, wherein said lens is fixed in said housing and all of said paths through said lens.

4. The apparatus defined in claim 1, wherein said paths impinge on said drum at their termini in directions substantially radial of the axis of rotation of said drum.

5. The apparatus defined in claim 1, wherein said drum is cylindrical and has an electrostatically chargeable and photosensitive surface.

6. The apparatus defined in claim 1, and further comprising an additional carriage linearly displaceable in said housing synchronously with the first-mentioned carriage and carrying said one mirror of each set, and means for displacing said additional carriage in a direction parallel to the displacement direction of said first-mentioned carriage at a rate equal to substantially half of said scanning speed.

7. The apparatus defined in claim 1, further comprising an additional carriage linearly displaceable in said housing synchronously with the first-mentioned carriage and carrying said one mirror of each set, and means for displacing said additional carriage in a direction forming an acute angle with said master, said one mirror of each set being substantially orthogonal to said master.

8. Apparatus defined in claim 7, wherein said additional carriage is displaced in said transport direction at a rate equal to $v/(2 \cos \alpha)$, wherein $v$ is said scanning speed and $\alpha$ is said acute angle, that mirror which in each set is closest in the respective path to said master being carried on said first carriage.

9. The apparatus defined in claim 6, wherein each path passes through a respective such lens fixed in said housing.

* * * * *